United States Patent [19]

Ayala

[11] Patent Number: 4,640,063

[45] Date of Patent: Feb. 3, 1987

[54] REINFORCING BAR SUPPORT CLIP

[76] Inventor: Henry Ayala, 605 Broussard Dr., Thousand Oaks, Calif. 91360

[21] Appl. No.: 765,140

[22] Filed: Aug. 13, 1985

[51] Int. Cl.[4] ..... E04B 1/00

[52] U.S. Cl. ..... 52/127.3; 52/712; 52/714; 249/205; 249/207; 249/219 R

[58] Field of Search ..... 52/127.3, 295, 677, 52/680, 682, 684, 712, 714, 742; 249/207, 219 R

[56] References Cited

U.S. PATENT DOCUMENTS

| | | | |
|---|---|---|---|
| 1,788,180 | 1/1931 | White | 52/677 |
| 2,772,560 | 12/1956 | Neptune | 52/685 |
| 3,102,614 | 9/1963 | Lydard | 52/714 |
| 3,960,356 | 6/1976 | Adams | 249/205 |
| 4,193,573 | 3/1980 | Kinnucan | 249/205 |

*Primary Examiner*—William F. Pate, III
*Assistant Examiner*—Dan W. Pedersen
*Attorney, Agent, or Firm*—Jack Munro

[57] ABSTRACT

An integral wire clip one end of which is to slip over the top edge of an elongated cement form and be snugly connected thereto. The opposite end of the clip is formed into a spring biased section which includes a pocket. Within the pocket there is to be located a section of a reinforcing bar. With the reinforcing bar located within the pocket, the reinforcing bar is snugly held in its established position against the elongated form. The wire clip also includes a handle section to facilitate movement of a portion of the wire clip for the purpose of facilitating initial positioning of and disengagement of the reinforcing bar within the pocket.

2 Claims, 5 Drawing Figures

REINFORCING BAR SUPPORT CLIP

BACKGROUND OF THE INVENTION

The field of this invention relates to devices which provide, during the pouring of concrete, a work holder for retaining in position of reinforcing bars, portions of which are to be embedded within the concrete during pouring.

During most types of construction there is utilized concrete. Concrete is used in footings and slabs which basically constitute foundations for buildings, homes, and the like.

Interposed at numerous and various locations throughout the footing and slab are steel rods. One type of these steel rods is what is termed a reinforcing bar which is generally in the range of about one-half inch in diameter. Such reinforcing bars generally include special configurations such as side flanges and a series of ridges on the exterior surface of the bar to form a rough surface. The purpose of these special configurations are so that when the concrete is poured around the bar it is practically impossible to remove the bar from the concrete after the concrete has been set or affect rotation of the bar within the concrete.

In preparing a site for the pouring of concrete, forms are used which generally comprise wood 2×4's or other similar type of elongated structure positioned at the periphery of the area that is to be poured with concrete. These forms are connected to stakes which in turn are driven into the ground at locations exteriorly of the site that is to be poured in concrete. It is normal for the bottom edge of the form to be positioned so as to be flush with the upper surface of the concrete.

There are code requirements for the locating of reinforcing bars within the concrete which is generally in the range of every sixteen inches apart. A common configuration of each reinforcing bar comprises a straight upper section from which extends at an angle a straight lower section. The lower section is to be embedded within the concrete. The reason the lower section of the reiforcing bar is angled is so that it further diminishes the possibility that the reinforcing bar can ever be removed from the concrete after the concrete is poured. The reinforcing bar, when initially positioned prior to pouring of the concrete, must be located in a spaced relationship above the surface of the ground. This spacing is so that moisture cannot come into direct contact with the reinforcing bar which could possibly cause such to rust after an extended period of time, possibly causing premature deteration of the poured concrete foundation.

In the past, in order to locate the reinforcing bars in the proper position prior to pouring of the concrete, it has been normal to position individually each of the reinforcing bars against the form and then tying such by a piece of wire to the form. This tying is a time consuming operation and also a labor intensive operation. Normally it takes a single individual a minute to a minute and a half to tie a single reinforcing bar in position. It is not at all uncommon within a foundation for a single building to utilize two thousand or more such reinforcing bars. This means that a substantial amount of labor and/or time is required to "tie the steel".

SUMMARY OF THE INVENTION

The primary objective of the present invention is to utilize a clip to effect securing of a reinforcing bar to a form for cement which locates the reinforcing bar in its proper position in substantially less time than was heretofore possible.

Another objective is to construct a clip for a reinforcing bar which is capable of being reused.

The support clip of the present invention is formed of an integral wire member which is bent at one end thereof into a U-shaped section which is then to be slipped over the top edge of a cement form. The remaining portion of the support clip is formed into a configuration of a pair of laterally extending leg members which are located in a spaced apart manner. Each leg member includes a recessed area which forms a pocket. These pockets are in alignment with one another and are arranged to connect with a reinforcing bar. The support clip is constructed to exert a continuous bias pressing the reinforcing bar into snug location against the cement form. The support clip also includes a manual engageable handle member which can move the clip against the action of the bias to effect release of the reinforcing bar from the pocket.

DETAILED DESCRIPTION OF THE SHOWN EMBODIMENT

Figure 1:
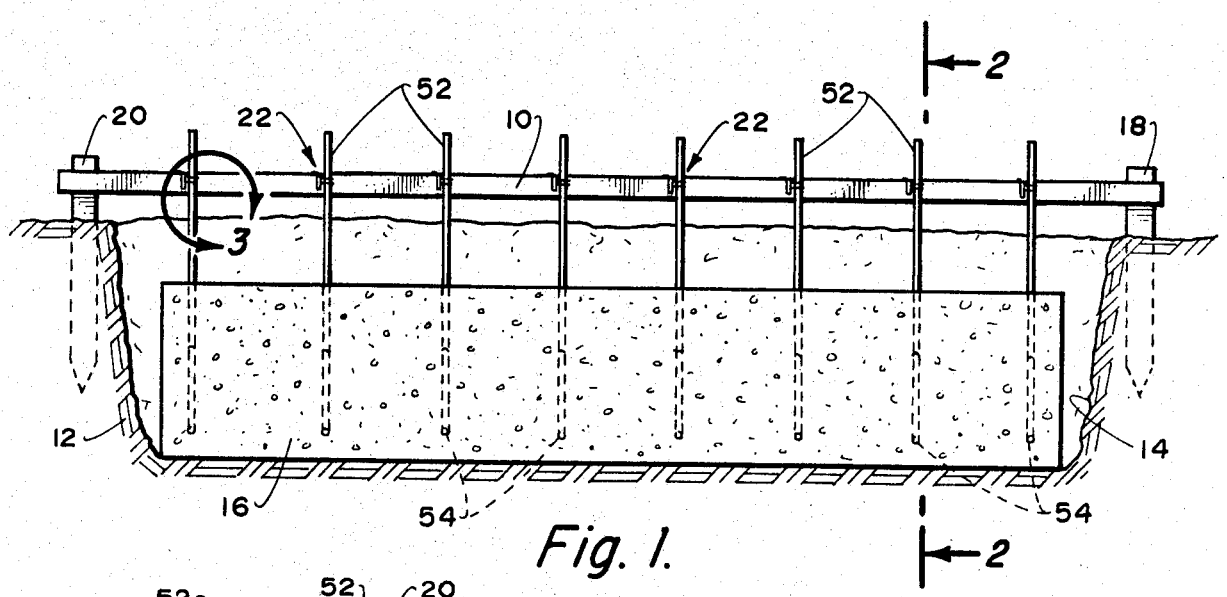
FIG. 1 is a front view depicting the typical pouring of a concrete footing and the arrangement of a cement form in conjunction therewith showing a plurality of the support clips of the present invention being utilized to connect with and support in the proper position a plurality of reinforcing bars, portions of which are embedded in the cement.

Referring particularly to the drawing the elongated cement form 10 will generally comprise a 2×4 wood member. This form 10 is located in a particular desired position as generally directly adjacent to a peripheral edge of a cement footing 16 which is to be poured of cement. The cement footing 16 is to be poured within a cavity 14 formed within the ground 12. One end of the form 10 is fixedly mounted to a stake 18 which is in turn driven within the ground 12. The opposite end of the form 10 is fixedly mounted to a stake 20 which also is driven into the ground 12.

The support clip 22 of the present invention is formed of an integral wire member defining basically a rear section and a front section. The rear section is basically U-shaped in configuration defined by parallel wire members 26 and 32 which are connected together by connecting wire member 28. The cement form 10 is to be located between the members 26 and 32 and abut against connecting member 28. The connecting member 28 also includes an offset section defined as an orientation tab 30. This orientation tab 30 is to be located flush against the upper surface of the form 10. This orientation tab 30 functions to precisely locate the support clip 22 on the cement form 10 so that members 26 and 32 are located perpendicular to the upper surface of the cement form 10.

The member 32 is connected to a member 34 which is located substantially in juxtaposition to member 32. Member 34 is connected to a laterally extending member 36 which in turn is connected to a member 38 which is in juxtaposition to member 36. Members 36 and 38 define a leg member which in general orientation is substantially perpendicular to member 34. The leg member, defined by members 36 and 38, is bent at its approximate mid-point which results in the forming of a concave inner surface which can be generally defined as a pocket 40.

The member 38 is integrally connected to member 42 which is located substantially in-line with member 34. The member 42 is connected to a pair of members 44 and 46 which are located again in juxtaposition. Members 44 and 46 are substantially identical in shape to members 36 and 38 and similarly include a recessed area on the inner surface thereof defining a portion of the pocket 40.

Member 46 is connected to an outwardly extending member 48 which terminates at a downwardly extending member 50. The member 50 constitutes a handle member which can be manually grasped and the point of connection of the members 46 and 48 is to be moved against either the surface of the form 10 or member 32 and, upon further deflection of the member 50, a pivoting occurs of the members 36, 38, 44 and 46 tending to move such further away from the front surface of the form 10. With the handle 50 in this position, the operator can then locate a reinforcing bar 52 within the pocket 40. Upon release of the handle 50, the leg members defined by members 36, 38, 44 and 46 will then deflect by spring action toward the front surface of the form 10 and result in binding or clamping of the reinforcing bar 52 snugly against the front surface of the form 10 thereby holding such in its established position. It is to be understood that this clamping action of the reinforcing bar 52 is accomplished prior to the pouring and setting of the cement 16. It is also understood that this clamping of the portion of the reinforcing bar 52 has to do with the portion of the reinforcing bar that extends exteriorly above the cement footing 16. The reinforcing bar 52 will generally include an angled lower end 54 embedded within the cement 16.

Figure 2:
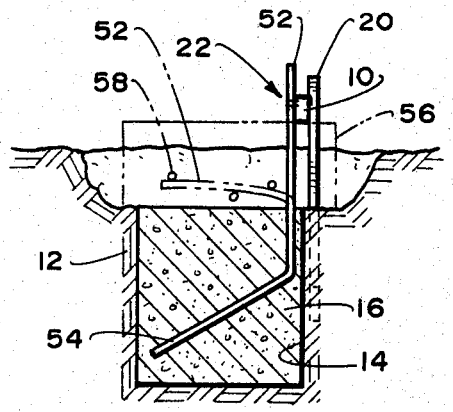
FIG. 2 is a cross-sectional view taken along line 2—2 of FIG. 1.
Figure 3:
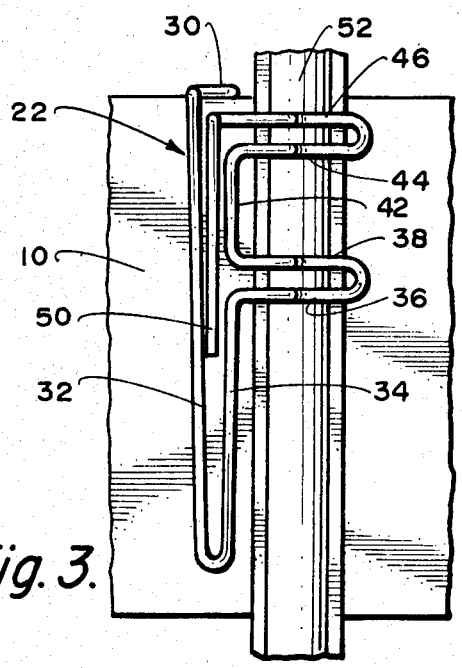
FIG. 3 is an enlarged front view of the support clip of the present invention taken along line 3—3 of FIG. 1.
Figure 5:
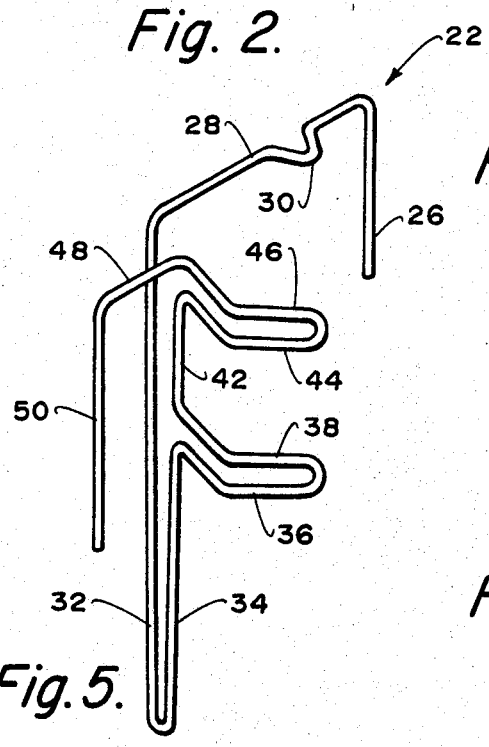
FIG. 5 is an isometric view of the support clip of the present invention.
Figure 4:
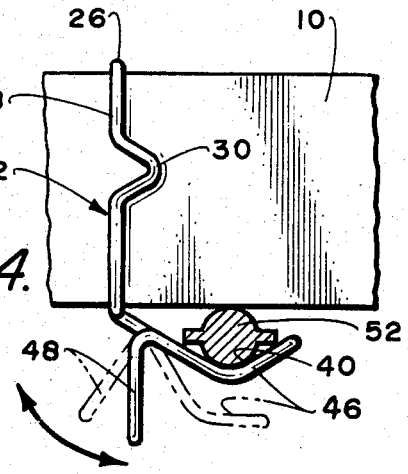
FIG. 4 is a top view of the support clip of the present invention as it is shown installed within FIG. 3.

After the cement footing 16 has been poured and hardened, the operator will normally remove each of the support clips 22 from their respective reinforcing bar 52 and then from the form 10. The disengagement from their respective reinforcing bar 52 can be easily accomplished by deflecting again of the handle member 50 which will result in the outward pivoting of the leg members 36, 38, 44 and 46 away from the surface of the reinforcing bar 52. The support clip 22 is then removed completely from the cement form 10. At this particular time it would be common to manually cause bending of the portion of the reinforcing bar 52 which protrudes from the cement footing 16 to a bent position as shown in phantom in FIG. 2 of the drawing. At this particular time it would also be normal to connect between these bent-over ends of the reinforcing bars 52 a plurality of steel tie rods 58. The cement slab 56 is then poured on top of cement footing 16 embedding both the bent-over ends of the reinforcing bars 52 and the tie rods 58.

What is claimed is:

1. In combination with an elongated form, said elongated form being fixedly positioned at a particular location, said elongated form having a top surface, a cavity located directly adjacent said elongated form, said cavity to have cement poured therein, a reinforcing bar located within said cavity prior to pouring of said cement, a portion of said reinforcing bar extending exteriorly of said cement, a support clip for mounting said portion of said reinforcing bar onto said elongated form prior to pouring of said cement, said support clip comprising:

an integral wire member defining a front section and a rear section, said rear section including engaging means, said engaging means for fixedly mounting said wire member onto said elongated form;

said front section including a pocket, said reinforcing bar to be located within said pocket, said pocket exerting a continuous bias tending to hold said reinforcing bar tightly against said elongated form, said front section including a handle member, said handle member being manually operable to move said pocket a greater distance from said elongated form permitting locating of and removal of said reinforcing bar from said pocket;

said engaging means comprising a U-shaped section, said U-shaped section to be slipped over said elongated form and tightly engage therewith;

said pocket being defined by a pair of spaced apart leg members; and said rear section further including an orientation tab, said orientation tab being abuttingly located against said top surface of said elongated form thereby automatically orienting said wire member at the proper position when engaged with said elongated form.

2. In combination with an elongated form, said elongated form being fixedly positioned at a particular location, said elongated form having a top surface, a cavity located directly adjacent said elongated form, said cavity to have cement poured therein, a reinforcing bar located within said cavity prior to pouring of said cement, a portion of said reinforcing bar extending exteriorly of said cement, a support clip for mounting said portion of said reinforcing bar onto said elongated form prior to pouring of said cement, said support clip comprising:

an integral wire member defining a front section and a rear section, said rear section including engaging means, said engaging means for fixedly mounting said wire member onto said elongated form;

said front section including a pocket, said reinforcing bar to be located within said pocket, said pocket exerting a continuous bias tending to hold said reinforcing bar tightly against said elongated form, said front section including a handle member, said handle member being manually operable to move said pocket a greater distance from said elongated form permitting locating of and removal of said reinforcing bar from said pocket; and said rear section further including an orientation tab, said orientation tab being abuttingly located against said top surface of said elongated form thereby automatically orienting said wire member at the proper position when engaged with said elongated form.

* * * * *